US009393612B2

(12) United States Patent
Lee et al.

(10) Patent No.: US 9,393,612 B2
(45) Date of Patent: Jul. 19, 2016

(54) AUTOMATED RAPID DISCHARGE FORMING OF METALLIC GLASSES

(71) Applicant: Glassimetal Technology, Inc., Pasadena, CA (US)

(72) Inventors: David S. Lee, Wenham, MA (US); Marios D. Demetriou, West Hollywood, CA (US); William L. Johnson, San Marino, CA (US); Joseph P. Schramm, Sierra Madre, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 438 days.

(21) Appl. No.: 14/081,858

(22) Filed: Nov. 15, 2013

(65) Prior Publication Data

US 2014/0130563 A1 May 15, 2014

Related U.S. Application Data

(60) Provisional application No. 61/726,883, filed on Nov. 15, 212.

(51) Int. Cl.

| | |
|---|---|
| ***B21J 17/02*** | (2006.01) |
| ***C21D 1/38*** | (2006.01) |
| ***C22F 1/00*** | (2006.01) |
| ***C22C 45/00*** | (2006.01) |
| ***B21K 27/02*** | (2006.01) |
| ***B21J 1/00*** | (2006.01) |

(52) U.S. Cl.

CPC *B21J 17/02* (2013.01); *B21J 1/006* (2013.01); *B21K 27/02* (2013.01); *C21D 1/38* (2013.01); *C22C 45/00* (2013.01); *C22F 1/00* (2013.01)

(58) Field of Classification Search

CPC ..... B21J 17/02; B21J 1/006; B21K 27/02; C21D 1/38; C22F 1/00; C22C 45/00

See application file for complete search history.

(56) References Cited

U.S. PATENT DOCUMENTS

| | | | |
|---|---|---|---|
| 3,332,747 | A | 7/1967 | Bundy |
| 3,537,045 | A | 10/1970 | Ichiro |

(Continued)

FOREIGN PATENT DOCUMENTS

| | | |
|---|---|---|
| CN | 1552940 | 12/2004 |
| CN | 1689733 | 11/2005 |

(Continued)

OTHER PUBLICATIONS

U.S. Appl. No. 14/501,563, filed Sep. 30, 2014, Lee et al.

(Continued)

*Primary Examiner* — David B Jones
(74) *Attorney, Agent, or Firm* — Polsinelli PC

(57) ABSTRACT

An automated rapid capacitive discharge apparatus is provided for sequentially or simultaneously rapidly heating and shaping a plurality of metallic glass feedstock samples. The apparatus includes a sample feeder defining a body for holding a plurality of samples and being capable of sequentially positioning at least one feedstock sample into a discharge position within the processing compartment. In the processing compartment the sample is heated by a discharge of a quantum of electrical energy supplied via electrodes, then shaped into a desired shape by means of a shaping tool, and subsequently moved out of the discharge position as a second feedstock moves into a discharge position.

20 Claims, 9 Drawing Sheets

(56) References Cited

U.S. PATENT DOCUMENTS

| | | | |
|---|---|---|---|
| 3,863,700 | A | 2/1975 | Bedell et al. |
| 4,115,682 | A | 9/1978 | Kavesh et al. |
| 4,355,221 | A | 10/1982 | Lin |
| 4,715,906 | A | 12/1987 | Taub et al. |
| 4,809,411 | A | 3/1989 | Lin et al. |
| 4,950,337 | A | 8/1990 | Li et al. |
| 5,005,456 | A | 4/1991 | Ballard et al. |
| 5,069,428 | A | 12/1991 | Li et al. |
| 5,075,051 | A | 12/1991 | Ito et al. |
| 5,278,377 | A | 1/1994 | Tsai |
| 5,288,344 | A | 2/1994 | Peker et al. |
| 5,324,368 | A | 6/1994 | Masumoto et al. |
| 5,368,659 | A | 11/1994 | Peker et al. |
| 5,550,857 | A | 8/1996 | Richards |
| 5,554,838 | A | 9/1996 | Berdich |
| 5,618,359 | A | 4/1997 | Lin et al. |
| 5,735,975 | A | 4/1998 | Lin et al. |
| 5,896,642 | A | 4/1999 | Peker et al. |
| 6,027,586 | A | 2/2000 | Masumoto et al. |
| 6,235,381 | B1 | 5/2001 | Sanders et al. |
| 6,258,183 | B1 | 7/2001 | Onuki et al. |
| 6,293,155 | B1 | 9/2001 | Babiel |
| 6,355,361 | B1 | 3/2002 | Ueno et al. |
| 6,432,350 | B1 | 8/2002 | Seres et al. |
| 6,771,490 | B2 | 8/2004 | Peker et al. |
| 6,875,293 | B2 | 4/2005 | Peker |
| 7,120,185 | B1 | 10/2006 | Richards |
| 7,506,566 | B2 | 3/2009 | Decristofaro et al. |
| 7,883,592 | B2 | 2/2011 | Hofmann et al. |
| 8,276,426 | B2 | 10/2012 | Musat et al. |
| 8,499,598 | B2 | 8/2013 | Johnson et al. |
| 8,613,813 | B2 | 12/2013 | Johnson et al. |
| 8,613,814 | B2 | 12/2013 | Kaltenboeck et al. |
| 8,613,815 | B2 | 12/2013 | Johnson et al. |
| 8,613,816 | B2 | 12/2013 | Kaltenboeck et al. |
| 2001/0033304 | A1 | 10/2001 | Ishinaga et al. |
| 2003/0183310 | A1 | 10/2003 | McRae |
| 2004/0035502 | A1 | 2/2004 | Kang et al. |
| 2005/0034787 | A1 | 2/2005 | Song et al. |
| 2005/0103271 | A1 | 5/2005 | Watanabe et al. |
| 2005/0202656 | A1 | 9/2005 | Ito et al. |
| 2005/0236071 | A1 | 10/2005 | Koshiba et al. |
| 2006/0102315 | A1 | 5/2006 | Lee et al. |
| 2006/0293162 | A1 | 12/2006 | Ellison |
| 2007/0003782 | A1 | 1/2007 | Collier |
| 2007/0034304 | A1 | 2/2007 | Inoue et al. |
| 2008/0081213 | A1 | 4/2008 | Ito et al. |
| 2008/0135138 | A1 | 6/2008 | Duan et al. |
| 2008/0302775 | A1 | 12/2008 | Machrowicz |
| 2009/0236017 | A1 | 9/2009 | Johnson et al. |
| 2010/0009212 | A1 | 1/2010 | Utsunomiya et al. |
| 2010/0047376 | A1 | 2/2010 | Imbeau et al. |
| 2010/0121471 | A1 | 5/2010 | Higo et al. |
| 2010/0320195 | A1 | 12/2010 | Fujita et al. |
| 2012/0006085 | A1 | 1/2012 | Johnson et al. |
| 2012/0103478 | A1 | 5/2012 | Johnson et al. |
| 2012/0132625 | A1 | 5/2012 | Kaltenboeck et al. |
| 2012/0255338 | A1 | 10/2012 | Johnson et al. |
| 2013/0001222 | A1 | 1/2013 | Kaltenboeck et al. |
| 2013/0025814 | A1 | 1/2013 | Demetriou et al. |
| 2013/0319062 | A1 | 12/2013 | Johnson et al. |
| 2014/0033787 | A1 | 2/2014 | Johnson et al. |
| 2014/0047888 | A1 | 2/2014 | Johnson et al. |
| 2014/0083150 | A1 | 3/2014 | Kaltenboeck et al. |
| 2014/0102163 | A1 | 4/2014 | Kaltenboeck et al. |
| 2015/0096967 | A1 | 4/2015 | Lee et al. |
| 2015/0231675 | A1 | 8/2015 | Johnson et al. |
| 2015/0299824 | A1* | 10/2015 | Prest ..... B22F 3/18 72/200 |
| 2015/0367410 | A1 | 12/2015 | Schramm et al. |

FOREIGN PATENT DOCUMENTS

| | | |
|---|---|---|
| CN | 103320783 | 9/2013 |
| FR | 2806019 | 9/2001 |
| GB | 215522 | 5/1924 |
| GB | 2148751 | 6/1985 |
| JP | 48-008694 | 3/1973 |
| JP | 63-220950 | 9/1988 |
| JP | 8-24969 | 1/1996 |
| JP | 08-300126 | 11/1996 |
| JP | 10-163739 | 10/1998 |
| JP | 10-296424 | 11/1998 |
| JP | 11-001729 | 1/1999 |
| JP | 11-104810 | 4/1999 |
| JP | 11-123520 | 11/1999 |
| JP | 11-354319 | 12/1999 |
| JP | 2000-119826 | 4/2000 |
| JP | 2000-169947 | 6/2000 |
| JP | 2001-321847 | 11/2001 |
| JP | 2001-347355 | 12/2001 |
| JP | 2003-509221 | 3/2003 |
| JP | 2005-209592 | 8/2005 |
| JP | 2008-000783 | 1/2008 |
| JP | 2011-517623 | 6/2011 |
| JP | 2013-530045 | 7/2013 |
| KR | 10-0271356 | 11/2000 |
| WO | WO 01/21343 | 3/2001 |
| WO | WO 2009/117735 | 9/2009 |
| WO | WO 2011/127414 | 10/2011 |
| WO | WO 2012/051443 | 4/2012 |
| WO | WO 2012/092208 | 7/2012 |
| WO | WO 2012/103552 | 8/2012 |
| WO | WO 2012/112656 | 8/2012 |
| WO | WO 2014/078697 | 5/2014 |

OTHER PUBLICATIONS

Saotome et al., "Characteristic behavior of Pt-based metallic glass under rapid heating and its application to microforming," *Materials Science and Engineering A*, 2004, vol. 375-377, pp. 389-393.

U.S. Appl. No. 14/216,565, filed Mar. 17, 2014, Schramm et al.

De Oliveira et al., "Electromechanical engraving and writing on bulk metallic glasses", Applied Physics Letters, Aug. 26, 2002, vol. 81, No. 9, pp. 1606-1608.

Duan et al., "Bulk Metallic Glass with Benchmark Thermoplastic Processability", Adv. Mater., 2007, vol. 19, pp. 4272-4275.

Ehrt et al., "Electrical conductivity and viscosity of borosilicate glasses and melts,"Phys. Chem. Glasses: Eur. J. Glass Sci. Technol. B, Jun. 2009, 50(3), pp. 165-171.

Love, "Temperature dependence of electrical conductivity and the probability density function," J. Phys. C: Solid State Phys., 16, 1983, pp. 5985-5993.

Mattern et al., "Structural behavior and glass transition of bulk metallic glasses,"Journal of Non-Crystalline Solids, 345&346, 2004, pp. 758-761.

Wiest et al., "Zi-Ti-based Be-bearing glasses optimized for high thermal stability and thermoplastic formability", Acta Materialia, 2008, vol. 56, pp. 2625-2630.

Yavari et al., "Electromechanical shaping, assembly and engraving of bulk metallic glasses", Materials Science and Engineering A, 2004, vol. 375-377, pp. 227-234.

Yavari et al., "Shaping of Bulk Metallic Glasses by Simultaneous Application of Electrical Current and Low Stress", Mat. Res. Soc. Symp. Proc., 2001, vol. 644, pp. L12.20.1-L12.20.6.

Demetriou, Document cited and published during Applicant Interview Summary conducted on Jan. 29, 2013, entitled, "Rapid Discharge Heating & Forming of Metallic Glasses: Concepts, Principles, and Capabilities," Marios Demetriou, 20 pages.

* cited by examiner

AUTOMATED RAPID DISCHARGE FORMING OF METALLIC GLASSES

CROSS-REFERENCE TO RELATED APPLICATIONS

The present application claims priority to U.S. Provisional Patent Application No. 61/726,883, entitled "Automated Rapid Discharge Forming of Metallic Glasses", filed on Nov. 15, 2012, which is incorporated herein by reference in its entirety.

TECHNICAL FIELD

The present disclosure is directed to an approach for rapid process sequencing to automate the rapid discharge heating and forming (RDHF) process of metallic glasses.

BACKGROUND

U.S. Patent Publication No. 2009/0236017, entitled "Forming of Metallic Glass by Rapid Capacitor Discharge", is directed to a method of rapidly heating a metallic glass sample and shaping it into an amorphous article using a rapid discharge of electrical current, where a quantum of electrical energy is discharged through a metallic glass sample having a substantially uniform cross-section to rapidly heat the sample to a processing temperature between the glass transition temperature of the metallic glass and the equilibrium melting temperature of the glass forming alloy and simultaneously or subsequently shaping and then cooling the sample to form an amorphous article. Other U.S. Patent publications are also related to the rapid heating and shaping an amorphous articles by discharge of electric current, including: U.S. Patent Publication No. 2012/0132625, entitled "Forming of Metallic Glass by Rapid Capacitor Discharge Forging", U.S. Patent Publication No. 2012/0255338, entitled "Sheet Forming of Metallic Glass by Rapid Capacitor Discharge", U.S. Patent Publication No. 2013/0001222, entitled "Forming of Ferromagnetic Metallic Glass by Rapid Capacitor Discharge Forging", and U.S. Patent Publication No. 2013/0025814, entitled "Injection Molding of Metallic Glass by Rapid Capacitor Discharge". Each of the foregoing publications is incorporated herein by reference in its entirety.

The Rapid Discharge Heating and Forming (RDCF) process involves rapidly discharging a quantum of electrical current across a metallic glass feedstock via electrodes in contact with the feedstock in order to rapidly (e.g. on the order of 500-$10^5$ K/s) and substantially uniformly heating the feedstock sample to a temperature conducive for viscous flow. Once the heated feedstock reaches that desired viscous state, a deformational force is applied to the heated and softened feedstock to deform the feedstock into a desirable shape. The feedstock sample may be shaped into an amorphous bulk article via any number of techniques including, for example, injection molding, dynamic forging, stamp forging, blow molding, etc. The steps of heating and deformation are performed over a time scale shorter than the time required for the heated feedstock to crystallize. Subsequently, the deformed feedstock is allowed to cool to a temperature substantially close to the glass transition temperature, typically by contact with a thermally conductive shaping tool such as a metal mold or die, in order to vitrify it into an amorphous article.

There remains a need to develop an automated apparatus for RDHF to allow large-scale production of amorphous articles by the rapid discharge heating and forming technique.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

BRIEF SUMMARY

Figure 1:
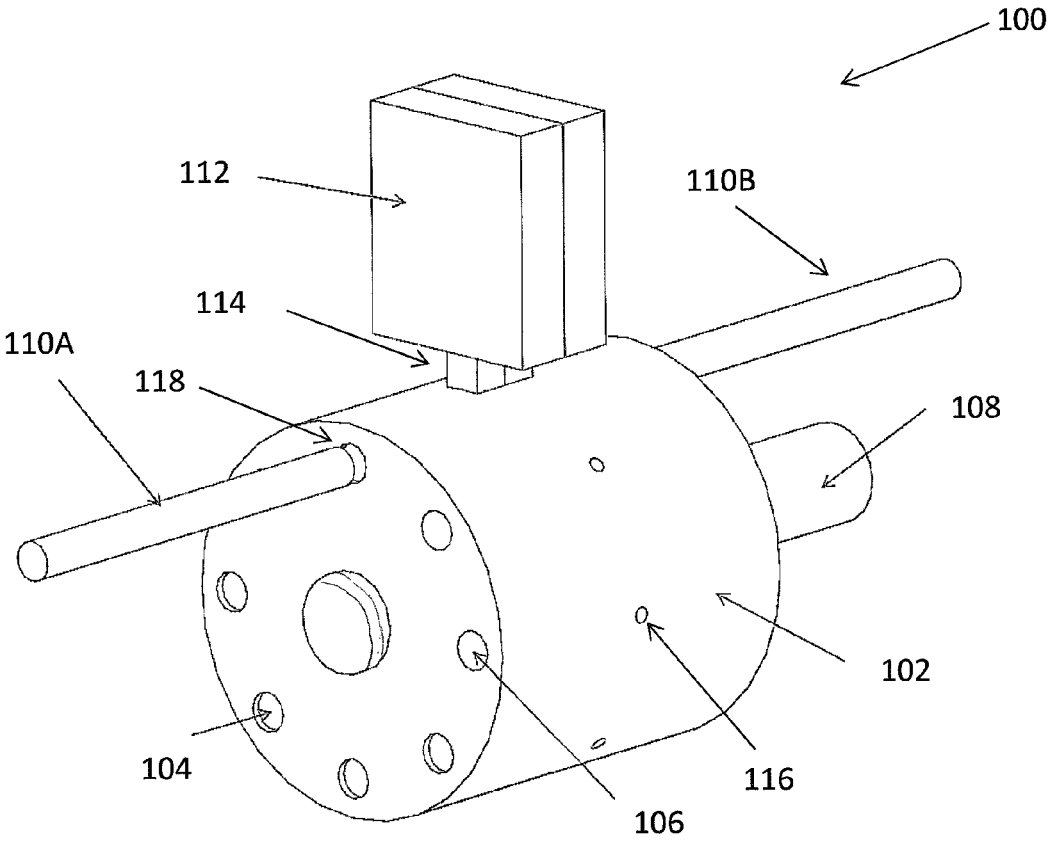
FIG. 1 illustrates a perspective view of one embodiment of an RDHF apparatus operating in the injection molding mode including a revolving feedstock magazine and a single mold in accordance with embodiments of the present disclosure.

The present disclosure is directed to an apparatus for automating the rapid discharge heating and forming (RDHF) metallic glass articles. The automated apparatus can uniformly heat sequentially or simultaneously delivered feedstock metallic glass samples rapidly (typically with processing times of less than 1 second) by Joule heating, or putting electric current through the metallic glass, and shaping each metallic glass sample into an amorphous article using a shaping tool. The present disclosure is also directed to methods for sequencing delivery of feedstock samples for the automated RDHF apparatus.

The apparatus can sequentially or simultaneously rapidly heat and shape a plurality of bulk metallic glass samples or feedstock samples. The apparatus includes at least two feedstock samples, where each feedstock sample has a substantially uniform cross-section. The apparatus also includes at least one pair of two electrodes interconnected to a source of electrical energy and at least one shaping tool for shaping the heated feedstock sample into an amorphous article. In some embodiments, the apparatus may include at least one sample feeder defining a body for holding a plurality of feedstock samples and being capable of sequentially positioning at least one feedstock sample into a discharge position within at least one chamber, where each chamber includes a fluid connection to the shaping tool. In other embodiments, the apparatus may include at least one processing compartment defining an enclosure for holding one of the feedstock samples, where the processing compartment includes a channel connecting to the shaping tool.

In one embodiment, a rapid discharge heating and forming apparatus is provided. The apparatus includes at least one sample feeder comprising a plurality of feedstock chambers. Each feedstock chamber is configured to hold a feedstock sample. The sample feeder is configured to sequentially position at least one of the plurality of feedstock samples at a discharge position within the feedstock chamber. At least one pair of two electrodes interconnected to a source of electrical energy is provided. Each one of the pair of electrodes is disposed at an opposing end of the feedstock sample such that the electrodes configured to electrically connect to the feedstock sample at the discharge position and heat the feedstock sample at the discharge position. The apparatus also includes a shaping tool configured to shape the heated feedstock sample to form an amorphous article.

In various embodiments, the sample feeder comprises a plurality of separate feedstock chambers. Each feedstock chamber is configured to contain a single feedstock sample, and is movable into the discharge position.

In another embodiment, an automated rapid discharge heating and forming apparatus is provided. The apparatus includes a single chamber that serves as a processing compartment operably associated with at least one sample feeder. The sample feeder is configured to hold a plurality of feedstock samples and to sequentially place at least one of the plurality of feedstock samples into the processing compartment at a discharge position.

In various embodiments, the sample feeder comprises a single feedstock chamber, and is configured to sequentially place each of the plurality of feedstock samples into the feedstock chamber at the discharge position.

In various embodiments, the sample feeder is configured to provide each of the plurality of feedstock samples along a chain or a belt comprising a plurality of sample engagement seats configured to releasably retain a feedstock sample. In various embodiments, the sample feeder is coupled to a feedstock sample source such that each of the feedstock samples falls into the feedstock chamber by gravity. In various embodiments, the apparatus includes at least one of a spring loading or a pneumatic pressure component configured to move each of the plurality of feedstock samples into the feedstock chamber.

In various embodiments, the feedstock chamber is fluidly connected to at least one corresponding feedstock channel. Each feedstock channel is fluidly connected to at least one shaping tool that serves as a mold.

In yet another embodiment, the shaping tool is configured to eject the amorphous article after the amorphous article has cooled to below 100 degrees above the glass transition temperature of the amorphous article, and before deformational force is applied to a second heated feedstock sample in the feedstock chamber.

In yet another embodiment, a plurality of shaping tools is provided each shaping tool is configured to be sequentially positioned in fluid connection with the chamber prior to applying a deformational force to a feedstock sample.

In yet another embodiment, the shaping tool is a mold comprising at least one cavity having a desirable shape and at least one runner and is fluidly connected to the chamber, such that following application of the deformational force the viscous feedstock sample is urged out of the chamber through the mold runner and into the mold cavity.

In yet another embodiment, the shaping tool is a forging die configured to apply a deformational force to the heated feedstock sample contained inside the chamber to forge the viscous feedstock sample into a desirable shape defined by the interior surfaces of the forging die in contact with the sample.

In yet another embodiment, a method for rapid discharge heating and forming of an amorphous article is provided. The method includes placing a first feedstock sample, which can have a uniform cross-section, at a discharge position in the apparatus. The method also includes discharging a quantum of electrical energy through the feedstock sample to heat the first feedstock sample. The method further includes applying a deformational force to the heated sample to shape the sample using a shaping tool and subsequently cooling it to form a first amorphous article. The method also includes automatically placing a second feedstock sample at the discharge position.

In various embodiments, the uniform cross-section has a certain amount of variability to be considered substantially uniform. Substantially uniform cross-sections can include, for example, slight variations in one of the dimensions of the described object.

In a further embodiment, a method for rapid discharge heating and forming an amorphous article is provided. The method includes placing a first feedstock sample having a substantially uniform cross section in a chamber serving as a processing compartment at the discharge position. The method also includes discharging a quantum of electrical energy through the first feedstock sample to heat the sample. The method further includes applying a deformational force to the heated feedstock sample to shape the sample using a shaping tool and subsequently cooling it to form a first amorphous article. The method further includes placing a second feedstock sample having a substantially uniform cross section into the processing compartment.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

DETAILED DESCRIPTION

In the present disclosure, apparatus and methods are provided to improve the efficiency of producing amorphous articles from metallic glasses. An RDHF apparatus or instrument can be loaded with a number of samples of metallic glass, which are also referred to as feedstock samples. In order to leverage the rate at which the RDHF instrument can process feedstock samples, the instrument can be designed to rapidly load feedstock samples and process them into amorphous articles. In some embodiments, this can be accomplished in automated fashion. This loading and processing improves the overall efficiency of the RDHF process.

The feedstock samples can be processed sequentially or simultaneously by the RDHF apparatus such that the RDHF process is effectively automated. Sample loading is accomplished by positioning one of the feedstock samples from a sample feeder at a discharge position in electrical and mechanical contact with the electrodes in a processing compartment or chamber of the RDHF instrument.

Once in the processing compartment or chamber, the feedstock sample undergoes joule heating via the electrodes, and after being heated rapidly and substantially uniformly to a temperature conducive for viscous flow. In various embodiments, this can lie between the glass transition temperature of the metallic glass and the equilibrium melting temperature of the glass forming alloy, deformational force is applied to the heated feedstock sample in order to deform it into a desirable shape.

After the heated sample is shaped into an article and is cooled to a temperature substantially close to the glass transition temperature by conduction with the shaping tool, and before deformational force is applied to a second heated feedstock sample in the chamber, the processed amorphous articles may be ejected from the shaping tool. Alternatively or a shaping tool magazine including a number of shaping tools can move the filled shaping tool out of the forming position and move an empty shaping tool into a forming position where a second amorphous article can be formed. As such, ejection of the first amorphous article is not necessary prior to processing a second feedstock sample.

In some embodiments, the shaping tool is a mold comprising at least one cavity having a desirable shape and at least one runner and is fluidly connected to the chamber, such that following application of the deformational force the viscous heated feedstock is urged out of the chamber through the mold runner and into the mold cavity, where it is shaped into a desired shape and subsequently cooled by conduction with the mold. In these embodiments, the automated RDHF apparatus is said to operate in the injection molding mode.

In other embodiments, the shaping tool is a forging die configured to apply a deformational force to the heated feedstock sample contained inside the chamber to forge the viscous feedstock sample into a desirable shape defined by the interior surfaces of the forging die in contact with the sample. In these embodiments, the automated RDHF apparatus is said to operate in the forging mode.

Revolving Feedstock Magazine Embodiments

In some embodiments, the present disclosure provides an automated RDHF apparatus operating in the injection molding mode involving a revolving feedstock magazine having multiple feedstock chambers, where each feedstock chamber contains an appropriately sized feedstock sample ready to be positioned for processing.

FIG. 1 illustrates a perspective view of an RDHF apparatus including a revolving feedstock magazine and a single mold in a shaping tool in accordance with embodiments of the present disclosure. Apparatus 100 includes a feedstock magazine 102 having a number of feedstock chambers 106. The feedstock magazine 102 is a sample feeder, which sequentially places a number of feedstock samples 104 from the number of feedstock chambers 106 at a discharge position 118 in an automated fashion. In a particular embodiment, the feedstock magazine 102 has a cylindrical shape and includes a number of feedstock chambers 106 circumferentially spaced apart from each other.

In a particular embodiment, the revolving feedstock magazine 102 includes at least two chambers 106, where each chamber can be sequentially rotated into a discharge position 118, either manually or in an automated fashion.

The sequential loading process may continue until all feedstock samples 104 loaded in the feedstock chambers 106 are processed. Alternatively, the feedstock chambers 106 can be reloaded with feedstock samples 104 in a different position, so that the RDHF instrument can continue without stopping to reload the feedstock chambers.

Figure 2:
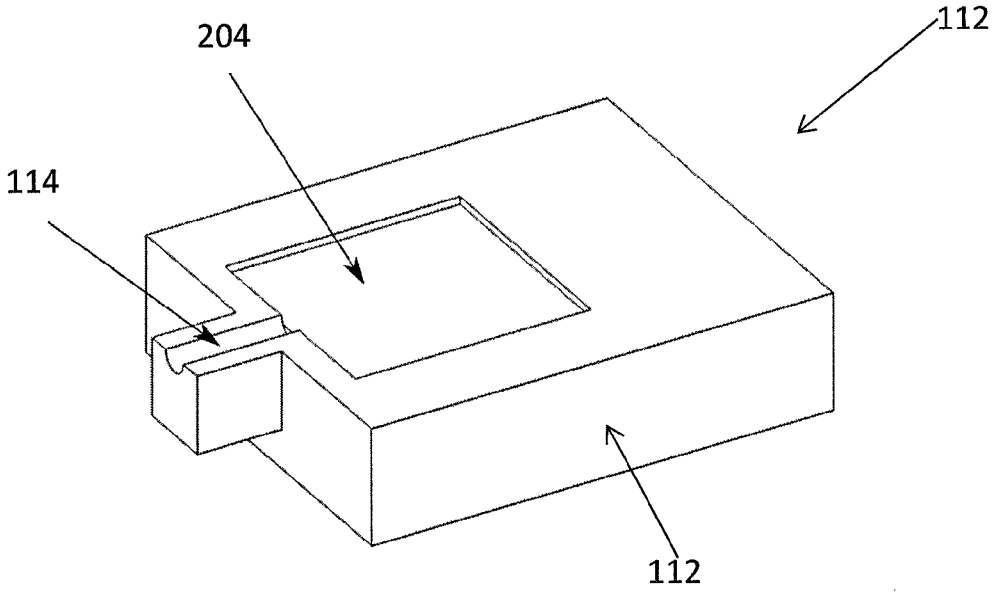
FIG. 2 illustrates a perspective view of a split portion of one embodiment of a mold comprising one runner and one cavity.

Apparatus 100 also includes a mold 112 which has at least one mold cavity 204 having a desired shape and at least one runner 114 as shown in FIG. 2. The mold 112 may be of split design (only one split portion of the mold is shown in FIG. 2), and may be capable of ejecting a processed part along with any remaining biscuit. Ejection of a first shaped article can occur after a first shaped article is cooled to a temperature substantially close to the glass transition temperature and prior to applying a deformational force to a second heated feedstock sample.

The feedstock magazine 102 also includes a number of corresponding channels 116 fluidly connected to each of the feedstock chambers 106. The channel 116 at the discharge position 118 allows the heated feedstock sample to flow into the mold 112, and specifically into the mold runner 114. Each feedstock chamber 106 can be loaded with a single feedstock sample 104.

The feedstock magazine 102 also includes a spindle 108 near the center of the feedstock magazine, which enables the feedstock magazine 102 to be rotated, either manually or automatically. The axis of each feedstock chamber 106 is substantially parallel to the axis of the spindle 108.

The apparatus 100 further includes a pair of electrodes 110 at the discharge position 118, which is the closest position of the feedstock magazine 102 to the mold 112. At least one feedstock sample 104 is placed inside the feedstock chamber 106 at the discharge position 118. One electrode 110 is positioned near one end of the feedstock sample 104, while another electrode 110 is positioned near an opposite end of the feedstock sample 104.

Each feedstock chamber 106 contains a feedstock sample 104, and is rotated into the discharge position between two electrodes 110, where an electrical voltage is applied to the electrodes to generate a quantum of electrical energy to rapidly and uniformly heat the sample in the feedstock chamber at the discharge position 118.

The electrical energy can be used to rapidly and substantially uniformly heat the sample to a predetermined processing temperature above the glass transition temperature of the metallic glass and below the equilibrium melting temperature of the glass forming alloy on a time scale not exceeding 0.5 seconds, such that the amorphous material has a process viscosity sufficient to allow facile shaping (about 1 to $10^4$ Pa-s or less). More specifically, the processing temperature is about half-way between the glass transition temperature of the metallic glass and the equilibrium melting temperature of the glass forming alloy.

In some embodiments, at least one of the two electrodes 110 also acts as a plunger to press the heated sample from the feedstock chamber 106 into the mold 112. While at the discharge position, at least a portion of the feedstock sample is exposed to at least one channel, which connects to at least one runner that connects to at least one mold cavity. As the electric current pulse is applied, a shaping pressure is applied, either simultaneously or subsequently, by at least one plunger to force the softened or heated metallic glass into the channel towards the mold. Following this sample discharging and heating, as well as the mold filling process, the plunger(s) is (are) retracted as the empty feedstock chamber is moved away from the discharge position, while another feedstock chamber with a second feedstock sample is moved into the discharge position.

In some embodiments, the feedstock chambers 106 or the entire feedstock magazine 102 may be made of non-conductive materials, including but not limited to ceramic and wood materials, among others. U.S. Patent Publication No. 2013/0025814, entitled "Injection Molding of Metallic Glass by Rapid Capacitor Discharge", is directed to a method and apparatus of injection molding metallic glass articles using the RCDF method, including the disclosure of an insulating feedstock barrel, or "barrel", that is used to electrically insulate and mechanically confine the heated feedstock prior to shaping. U.S. Patent Application No. 61/884,267, entitled "Cellulosic Feedstock Barrel for Use in Rapid Discharge Forming of Metallic Glasses", is directed to the use of cellulosic materials as barrels for the process of injection molding of metallic glasses by rapid capacitor discharge forming (RCDF) techniques. Each of the foregoing publications is incorporated herein by reference in its entirety.

In alternative embodiments, the feedstock chambers 106 may include a metal substrate coated with an insulating film on the interior that contacts the feedstock sample 104. More details are disclosed in U.S. Patent Application No. 61/886,477, entitled "Feedstock Barrels for Rapid Discharge Forming of Metallic Glasses Comprising Tough Substrates Coated with Insulating Films", which is incorporated herein by reference in its entirety.

In some embodiments, an apparatus may also include a revolving mold magazine having multiple mold cavities. Each mold cavity can house an amorphous article or a processed part. The mold magazine is movable (e.g. rotatable), either manually or automatically. While moving the feedstock chamber, one mold cavity containing a processed part may simultaneously, or around the same time, be moved away from a forming position once the processed part is formed at the forming position. Another empty mold cavity is then moved into the forming position. This configuration negates the need for ejecting the processed part prior to applying the deformational force to a second feedstock sample.

Figure 3:
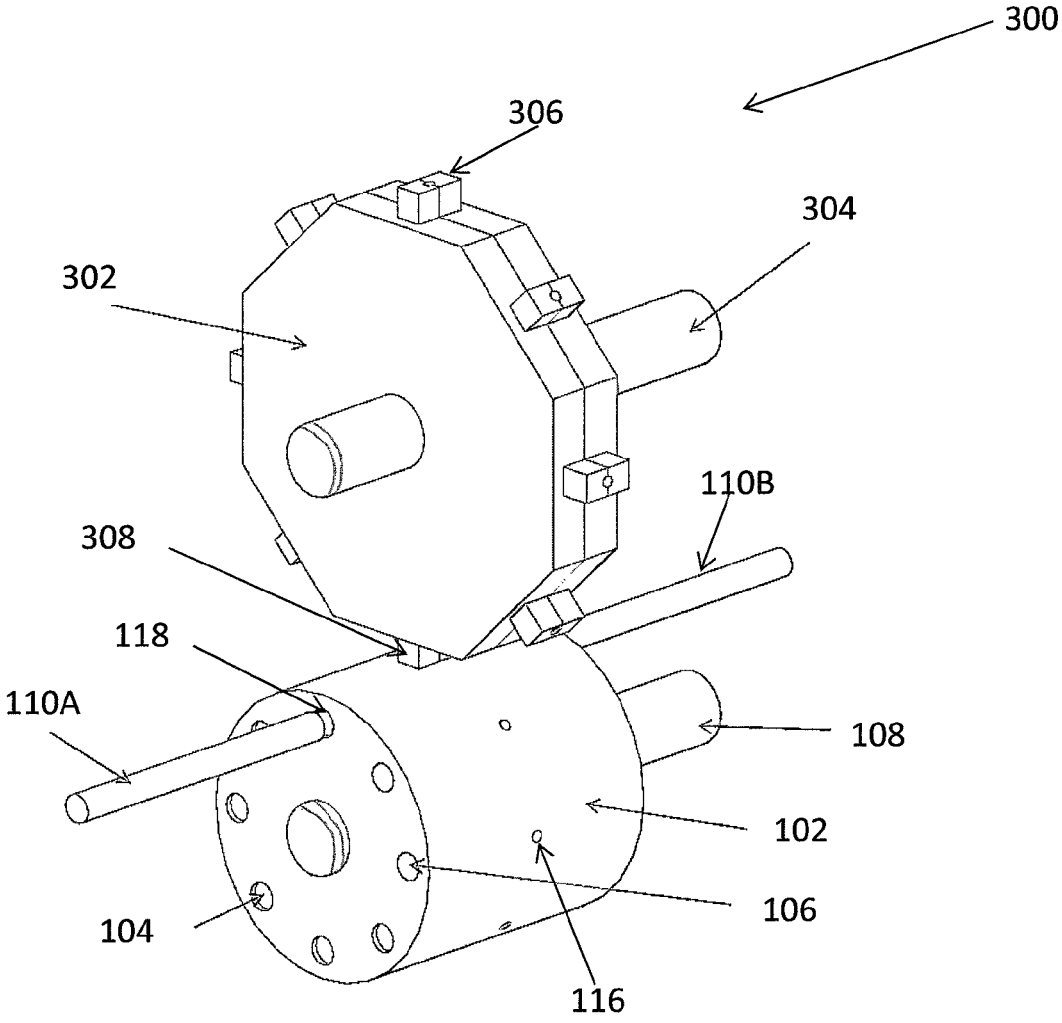
FIG. 3 illustrates a perspective view of one embodiment of an RDHF apparatus operating in the injection molding mode including a revolving feedstock magazine and a mold magazine with multiple mold cavities in accordance with embodiments of the present disclosure.

FIG. 3 illustrates a perspective view of an RDHF apparatus including a revolving feedstock magazine and a revolving mold magazine in accordance with embodiments of the present disclosure. RDHF apparatus 300 includes a feedstock magazine 102 and electrodes 110, which are similar to that shown in FIG. 1. RDHF apparatus 300 also includes a mold magazine 302 fluidly coupled to the feedstock magazine 102 at a forming position 308 through a mold runner 306. Specifically, the mold runner 306 at the forming position 308 fluidly connects to the channel 116 corresponding to the feedstock chamber 106 at the discharging position 118. The mold magazine 302 includes a number of mold cavities (not shown in this view) and corresponding mold runners 306 fluidly connected to the mold cavities. Each mold cavity rotates away from a forming position after a feedstock sample is processed, such that an empty mold cavity is moved into the forming position for the next processing stage. The mold magazine 302 may be opened to eject all the formed amorphous articles from the multiple mold cavities at once to reduce production time or cost.

Although this embodiment provides a mold as an example shaping tool, the shaping tool may include other types, including but not limited to, an injection mold, a die cast, a dynamic forge, a stamp forge, and a blow mold. The shaping tool may further include a temperature-controlled heating element for heating said tool to a temperature at or below the glass transition temperature of the metallic glass.

Example Linear (Side by Side) Feedstock Magazine

Figure 4:
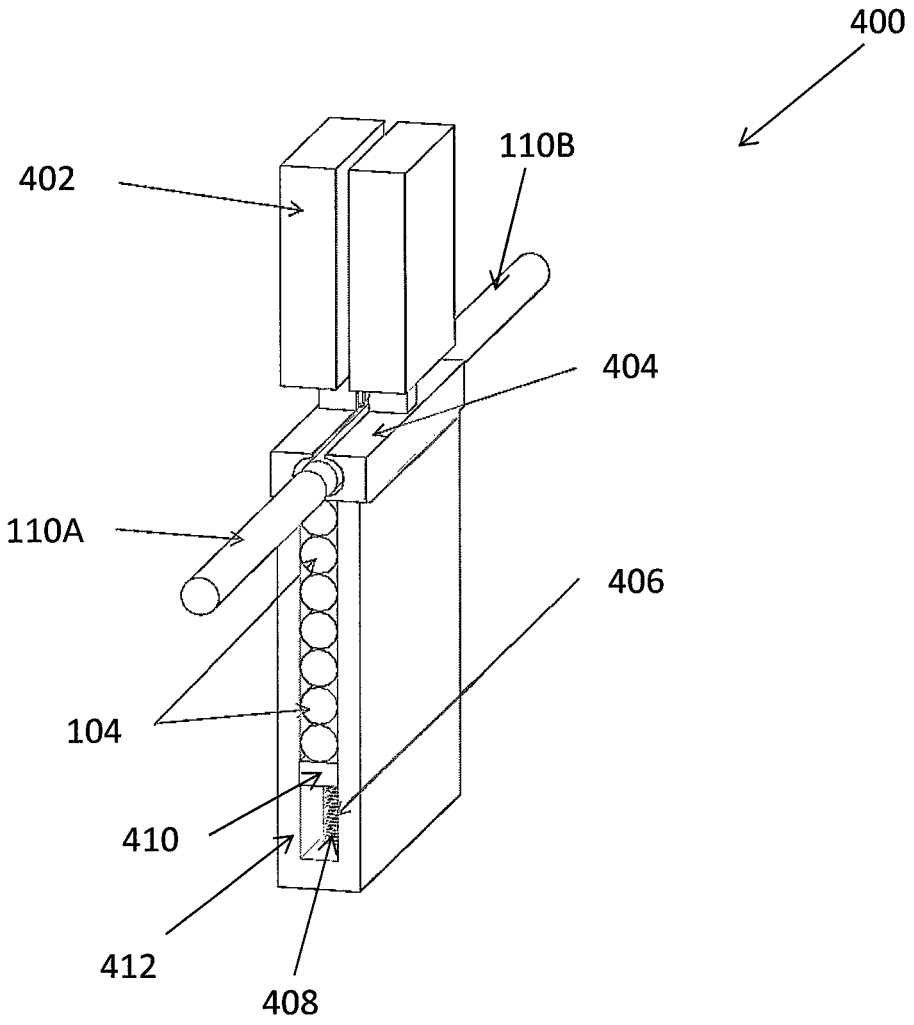
FIG. 4 illustrates a perspective view of one embodiment of an RDHF apparatus operating in the injection molding mode including a linear "side-by-side" feedstock magazine and a single split mold (shown in the open position) in accordance with embodiments of the present disclosure.

In some embodiments, an automated RDHF apparatus operating in the injection molding mode may include a feedstock magazine that can hold feedstock samples in a linear (side by side) magazine, and can operate to deliver feedstock samples sequentially in a linear motion. FIG. 4 illustrates a perspective view of an RDHF apparatus including a linear feedstock magazine and a single mold in accordance with embodiments of the present disclosure. RDHF apparatus 400 includes a linear feedstock magazine 406, a mold 402, a processing compartment 404 coupled between the linear feedstock magazine, and the mold.

The linear feedstock magazine 406 includes a housing 412 that holds a number of feedstock samples 104 in a linear stack. The feedstock samples 104 are stacked side by side like pellets in a machine gun, either without a spacer as shown in FIG. 4, or with a spacer between the feedstock samples (not shown).

RDHF apparatus 400 includes a processing compartment 404 positioned at one end of the linear feedstock magazine 406 near the mold 402, i.e. a chamber that can house feedstock samples at the discharge position. The processing compartment 404 is configured to open and close to allow the feedstock sample to be placed into the processing compartment.

In some embodiments, the processing compartment 404 may include two split portions as shown in FIG. 4. The processing compartment 404 is configured to close or separate from the top of the stack of feedstock samples 104 in the linear feedstock magazine 406 once an unprocessed feedstock sample 104 is loaded. The processing compartment 404 is used to house the feedstock, electrically insulate the feedstock during electrical discharge from the surrounding metal tooling, mechanically confine the heated feedstock once it reaches its viscous state, and guide the feedstock through a channel in the processing compartment and onto a mold runner that fluidly connects to a mold cavity which the softened feedstock can ultimately fill.

In alternative embodiments, the processing compartment may not be two split portions, but is instead a single housing with a movable bottom (not shown) to allow the feedstock sample to be placed into the processing compartment.

The mold 402 is capable of ejecting a processed part along with any remaining biscuit. Ejection of a first shaped article can occur after a first shaped article is cooled to a temperature substantially close to the glass transition temperature and prior to applying a deformational force to a second heated feedstock sample.

In some embodiments, the linear motion of the linear feedstock magazine may be aided by a spring device, as shown in FIG. 4. The linear feedstock magazine 402 includes a spring 408, which may press against a column of unprocessed feedstock samples which are positioned or arranged in a side by side configuration, such that the sample on top of the column is forced into the processing compartment 404.

In some embodiments, an unprocessed feedstock sample 104 may be loaded into a processing compartment by a gas injection system as an alternative to the mechanical sample loader, such as the spring 408. For example, the gas injection system may use gas pressure to load the feedstock sample into the processing compartment.

The linear feedstock magazine 402 may further include a spacer 410, which separates the spring 408 from the feedstock sample and provides substantially uniform pressure to the feedstock sample 408 from the bottom of the linear feedstock magazine 406.

In some embodiments, at least one of the two electrodes 110 also acts as a plunger to press the heated sample from the feedstock chamber 106 into the mold 302. While at the discharge position, at least a portion of the feedstock sample is exposed to at least one channel, which connects to at least one runner that connects to at least one mold cavity. As the electric current pulse is applied, a shaping pressure is applied, either simultaneously or subsequently, by at least one plunger to force the softened or heated metallic glass into the channel towards the mold. Following this sample discharging and heating, as well as the mold filling process, the plunger(s) is (are) retracted as the first shaped article is ejected while a second feedstock sample is moved into the discharge position.

In one embodiment, the processing compartment 404 may be made of a non-conductive material, similar to that disclosed with respect the feedstock chamber. In another embodiment, the processing compartment 404 may include a metal substrate coated with an insulating film on the interior that contacts the feedstock sample, similar to that disclosed with respect to the feedstock chamber.

The apparatus 400 further includes a pair of electrodes 110A-B coupled to the feedstock sample in the processing compartment 404 to apply electrical current to the feedstock sample in order to heat it. One electrode 110A is disposed at one end of the feedstock sample 104, while another electrode 110B is disposed at the opposite end of the feedstock sample 104. The two electrodes are interconnected to a source of electrical energy, where the source of electrical energy is capable of producing a quantum of electrical energy sufficient to heat at least one of a plurality of feedstock samples comprising a metallic glass to a processing temperature. In a particular embodiment, the processing temperature is between the glass transition temperature of the metallic glass formed from a glass forming alloy and the equilibrium melting temperature of the glass forming alloy.

Figure 5:
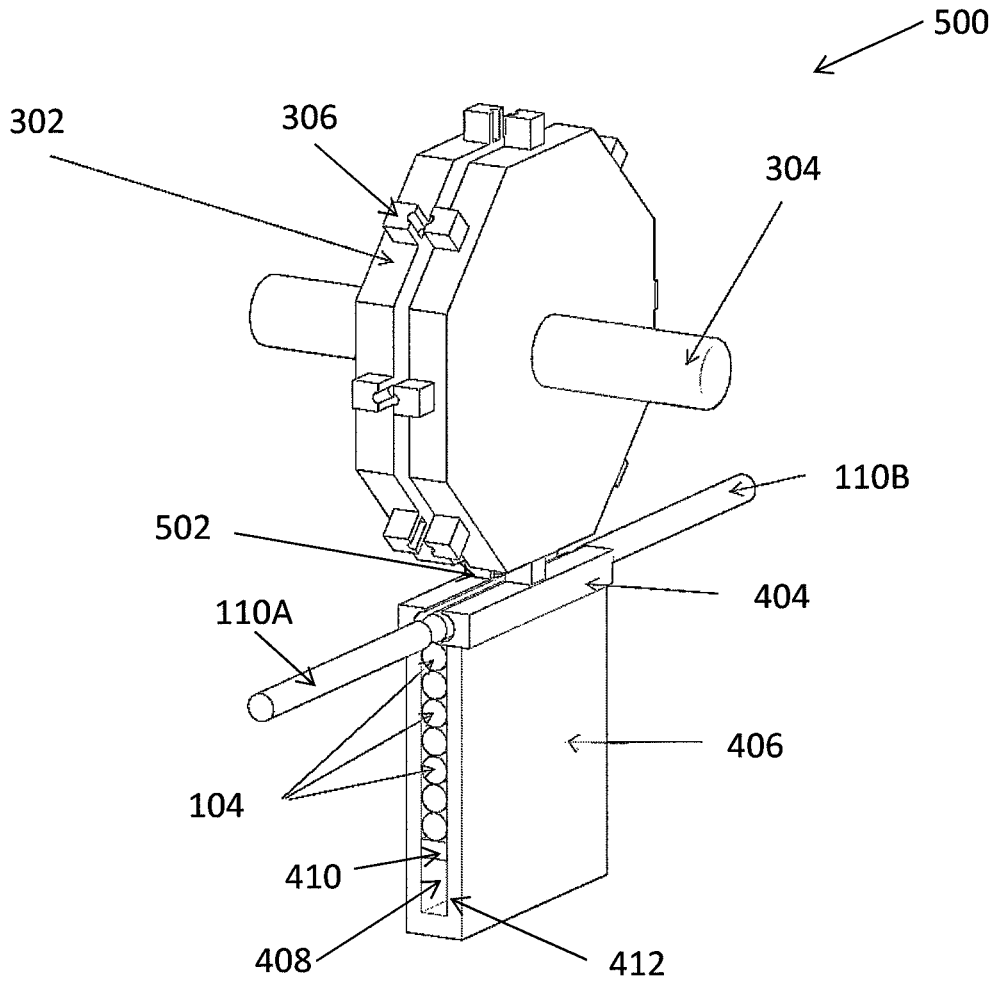
FIG. 5 illustrates a perspective view of one embodiment of an RDHF apparatus operating in the injection molding mode including a linear "side-by-side" feedstock magazine and a mold magazine with multiple mold cavities in accordance with embodiments of the present disclosure.

In some embodiments, the RDHF apparatus includes a linear feedstock magazine and a revolving mold magazine. FIG. 5 illustrates a perspective view of an RDHF apparatus including a linear feedstock magazine and a revolving mold magazine in accordance with embodiments of the present disclosure. Apparatus 500 includes a linear feedstock magazine 506, a processing compartment 404, and two electrodes 110A and 110B, similar to that shown in FIG. 4.

Apparatus 500 also includes a revolving mold magazine 302, similar to that described with respect to FIG. 3. The revolving mold magazine 302 includes a number of mold runners 306 coupled to corresponding mold cavities (not shown in this view) inside the mold magazine. The mold magazine 302 may include two split portions, and can be opened to eject processed parts from the mold cavities.

The mold magazine 302 can be rotated around a mold spindle 304 in the center of the mold magazine 302. The mold magazine 302 is arranged such that the mold spindle 304 is transverse to the axis of the feedstock samples 104, as shown in FIG. 5.

The mold runner 306 is positioned at a forming position 502 to allow the heated feedstock sample to be forced into the corresponding mold cavity from the processing compartment 404. The mold runners 306 may also include two split portions attached to the corresponding split portions of the mold magazine 302. The mold runners 306 can be opened with the mold magazine 302. The mold runners 306 attach to a circumferential edge of mold magazine 302 to eject the processed parts.

The linear feedstock magazine embodiments shown in FIGS. 4-7 provide a continuous supply of feedstock samples 104 that are stacked side by side and are delivered one by one in a linear motion to the processing compartment 404.

In some embodiments of the linear (side-by-side) approach, the feedstock magazine is a continuous chain or belt over which feedstock samples are attached side-by side on sample engagement seats configured to releasably retain a sample thereon, and are delivered one-by-one the processing compartment and placed into a discharge position.

Figure 6:
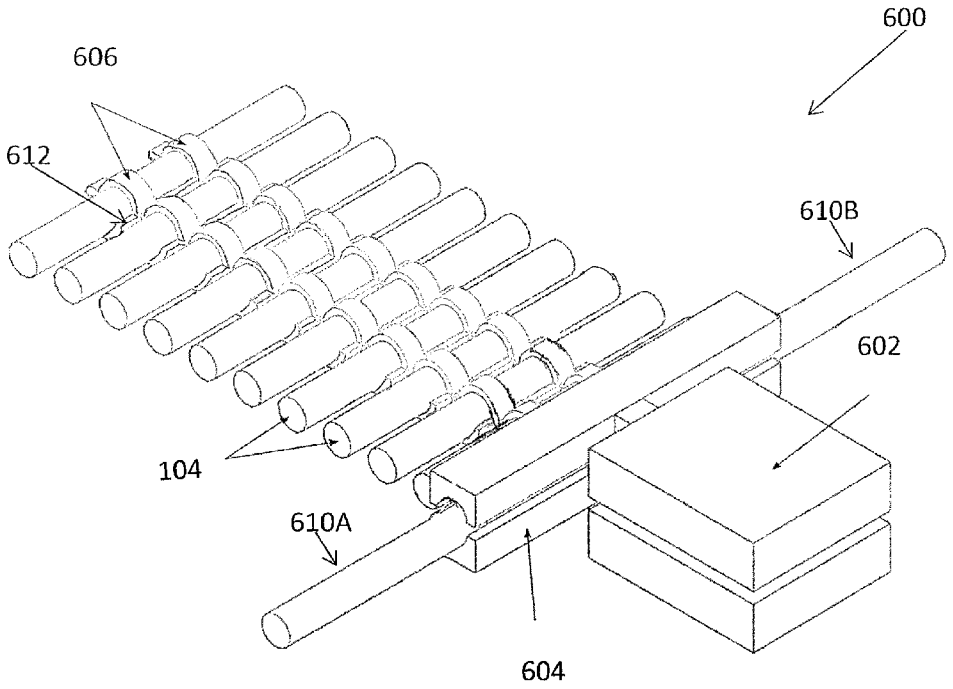
FIG. 6 illustrates a perspective view of one embodiment of an RDHF apparatus operating in the injection molding mode including a linear "side-by-side" feedstock magazine according to the continuous chain approach and a single split mold (shown in the open position) in accordance with embodiments of the present disclosure.

FIG. 6 illustrates a perspective view of an RDHF apparatus including a feedstock magazine according to the continuous chain approach and a single mold cavity in accordance with embodiments of the present disclosure. RDHF apparatus 600 includes a feedstock chain 606, a mold 602, a processing compartment 604 coupled between the linear feedstock chain 606, and the mold 602. The linear feedstock chain 606 includes a feedstock chain link 612 that hold a number of feedstock samples 104 in a linear stack. The feedstock samples 104 are stacked in serial, each separated by a feedstock chain link 612.

RDHF apparatus 600 includes a processing compartment 604 positioned at one end of the linear feedstock chain 606 near the mold 602, i.e. a chamber that can house feedstock samples at the discharge position. The processing compartment 604 is configured to open and close to allow the feedstock sample to be placed into the processing compartment.

In some embodiments, the processing compartment 604 can include two split portions as shown in FIG. 6. The processing compartment 604 is configured to close or separate from the top of the stack of feedstock samples 104 in the linear feedstock chain 606 once an unprocessed feedstock sample 104 is loaded. The processing compartment 604 is used to house the feedstock, electrically insulate the feedstock during electrical discharge from the surrounding metal tooling, mechanically confine the heated feedstock once it reaches its viscous state, and guide the feedstock through a channel in the processing compartment and onto a mold runner that fluidly connects to a mold cavity which the softened feedstock can fill.

In alternative embodiments, the processing compartment may not be two split portions, but is instead a single housing with a movable bottom (not shown) to allow the feedstock sample to be placed into the processing compartment.

The mold 602 is capable of ejecting a processed part along with any remaining biscuit. Ejection of a first shaped article can occur after a first shaped article is cooled to a temperature substantially close to the glass transition temperature and prior to applying a deformational force to a second heated feedstock sample.

In various embodiments, an unprocessed feedstock sample 104 can be loaded into a processing compartment 604 by moving feedstock chain 606 to the processing compartment 604.

In some embodiments, at least one of the two electrodes 110A-B also acts as a plunger to press the heated sample from the processing compartment 604 into the mold 602.

In some embodiments, the processing compartment 604 can be made of a non-conductive material, similar to that disclosed with respect the feedstock chamber. In another embodiment, the processing compartment 604 may include a metal substrate coated with an insulating film on the interior that contacts the feedstock sample, similar to that disclosed with respect to the feedstock chamber.

The apparatus 600 further includes a pair of electrodes 610A-B coupled to the feedstock sample in the processing compartment 604 to apply electrical current to the feedstock sample in order to heat it. One electrode 610A is disposed at one end of the feedstock sample 104, while another electrode 610B is disposed at the opposite end of the feedstock sample 104. The two electrodes are interconnected to a source of electrical energy, where the source of electrical energy is capable of producing a quantum of electrical energy sufficient to heat at least one of a plurality of feedstock samples comprising a metallic glass to a processing temperature. In a particular embodiment, the processing temperature is between the glass transition temperature of the metallic glass formed from a glass forming alloy and the equilibrium melting temperature of the glass forming alloy.

In other embodiments of the linear (side-by-side) approach, a feedstock magazine can be designed to move the last feedstock sample over an opening on the bottom of the feedstock magazine and falls into the processing compartment. Specifically, the feedstock magazine may be attached to a feedstock sample source that contains a number of feedstock samples, and may act as a hopper-type device. A feedstock sample from the sample source, such as a container, falls into a processing compartment by gravity at the end of the sample loader.

Figure 7:
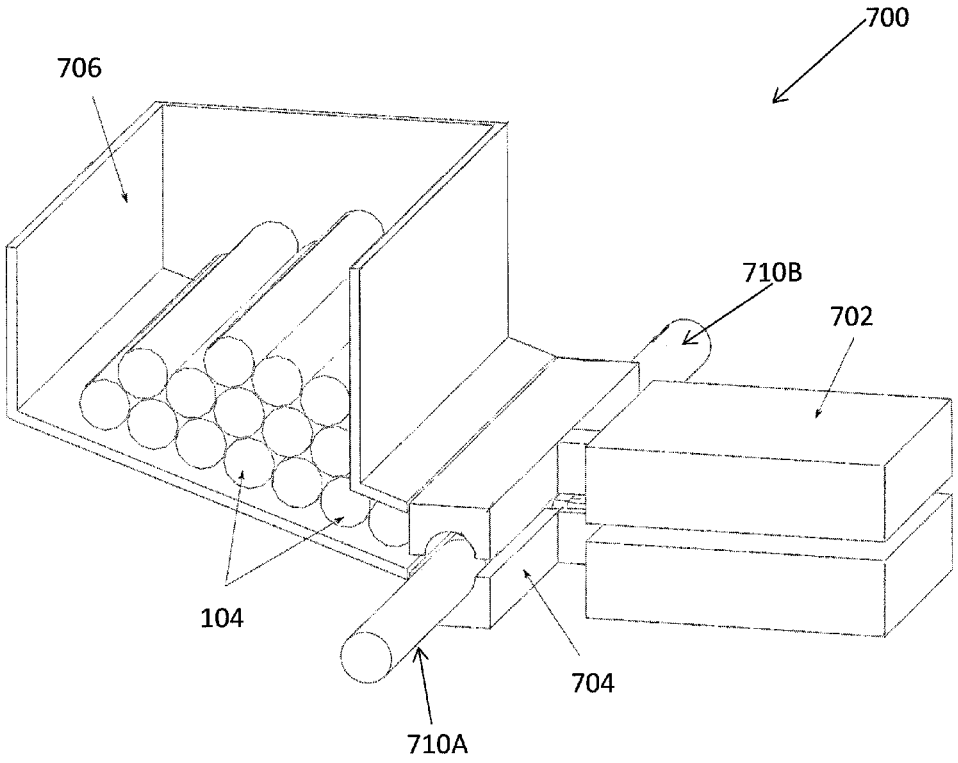
FIG. 7 illustrates a perspective view of one embodiment of an RDHF apparatus operating in the injection molding mode including a linear "side-by-side" feedstock magazine according to the hopper approach and a single split mold (shown in the open position) in accordance with embodiments of the present disclosure.

FIG. 7 illustrates a perspective view of an RDHF apparatus including a feedstock magazine according to the hopper approach and a single mold cavity in accordance with embodiments of the present disclosure. RDHF apparatus 700 includes a hopper 706 that contains feedstock samples 104, a mold 702, a processing compartment 704 operably associated with the hopper 706 the mold 702. The hopper 706 includes a feedstock chain link (not shown) that holds a number of feedstock samples 104 in a linear stack.

RDHF apparatus 700 includes a processing compartment 704 positioned at one end of the hopper 706 near the mold 702. The processing compartment 704 houses feedstock samples at the discharge position. The processing compartment 704 is configured to open and close to allow the feedstock sample to be placed into the processing compartment.

In some embodiments, the processing compartment 704 can include two split portions as shown in FIG. 7. The processing compartment 704 is configured to contain a single feedstock sample 104 taken from the hopper 706. The processing compartment 704 is used to house the feedstock, electrically insulate the feedstock during electrical discharge from the surrounding metal tooling, mechanically confine the heated feedstock once it reaches its viscous state, and guide the feedstock through a channel in the processing compartment and onto a mold runner that fluidly connects to a mold cavity which the softened feedstock can fill.

In alternative embodiments, the processing compartment may not be two split portions, but is instead a single housing with a movable bottom (not shown) to allow the feedstock sample to be placed into the processing compartment.

The mold 702 is capable of ejecting a processed part along with any remaining biscuit. Ejection of a first shaped article can occur after a first shaped article is cooled to a temperature substantially close to the glass transition temperature and prior to applying a deformational force to a second heated feedstock sample.

As disclosed in FIG. 7, an unprocessed feedstock sample 104 can be loaded from hopper 706 into a processing compartment 704 by gravity. It will be recognized that feedstock samples can be loaded from hopper 706 into the processing department 704 by pressure or some such other method.

In some embodiments, at least one of the two electrodes 710A-B also acts as a plunger to press the heated sample from the processing compartment 704 into the mold 702.

In some embodiments, the processing compartment 704 can be made of a non-conductive material, similar to that disclosed with respect the feedstock chamber. In another embodiment, the processing compartment 704 may include a metal substrate coated with an insulating film on the interior that contacts the feedstock sample, similar to that disclosed with respect to the feedstock chamber.

The apparatus 700 further includes a pair of electrodes 710A-B coupled to the feedstock sample in the processing compartment 704 to apply electrical current to the feedstock sample in order to heat it. One electrode 710A is disposed at one end of the feedstock sample 104, while another electrode 710B is disposed at the opposite end of the feedstock sample 104. The two electrodes are interconnected to a source of electrical energy, where the source of electrical energy is capable of producing a quantum of electrical energy sufficient to heat at least one of a plurality of feedstock samples comprising a metallic glass to a processing temperature. In a particular embodiment, the processing temperature is between the glass transition temperature of the metallic glass formed from a glass forming alloy and the equilibrium melting temperature of the glass forming alloy.

Although this embodiment provides a mold as an example shaping tool, the shaping tool may include other types, including but not limited to, an injection mold, a die cast, a dynamic forge, a stamp forge, and a blow mold. The shaping tool may further include a temperature-controlled heating element for heating said tool to a temperature at or below the glass transition temperature of the metallic glass.

Example Linear (End-to-End) Feedstock Magazine

Figure 8:
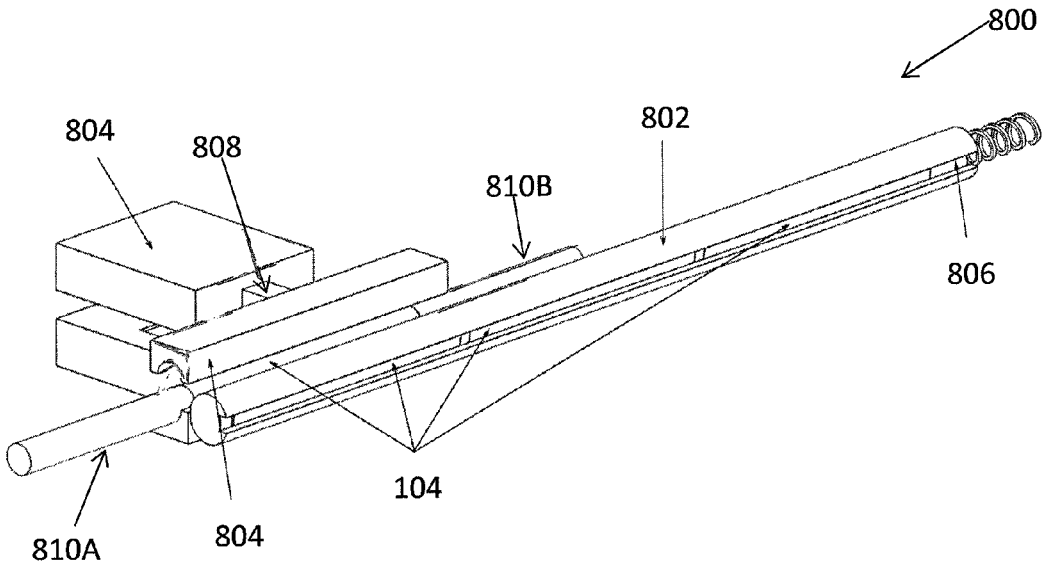
FIG. 8 illustrates a perspective view of one embodiment of an RDHF apparatus operating in the injection molding mode including a linear "end-to-end" feedstock magazine and a single split mold (shown in the open position) in accordance with embodiments of the present disclosure.

In some embodiments, a linear (end-to-end) feedstock magazine may include a long tubular feedstock chamber as shown in FIG. 8, which may contain feedstock samples arranged in an end-to-end fashion, either with or without spacers between the samples. FIG. 8 illustrates a perspective view of an RDHF apparatus including a tubular feedstock magazine and a single mold cavity in accordance with embodiments of the present disclosure. The barrel, electrode, and mold and their respective functions are substantially similar to those described for the Linear (Side-by-Side) Feedstock Magazine, demonstrated in FIGS. 4, 6 and 7. In some embodiments, the RDHF apparatus may include a revolving mold magazine to replace a single mold cavity, as shown in FIG. 5.

Apparatus 800 includes a tubular feedstock magazine 802, which houses a number of feedstock samples 104. The feedstock samples may be loaded by a spring-loading mechanism 806 on one end of the line of samples to maintain compression. The feedstock sample may be caught by a sample retaining catch pin on the other end of the line of feedstock samples. This long tubular magazine 802 may be positioned adjacent to and parallel with a processing chamber or compartment 804 located between two electrodes 810A-B.

In some embodiments, at least one of the electrodes may act as a plunger, and at least part of the processing chamber or compartment is open to at least one mold runner that connects to at least one mold cavity.

In some embodiments, the movement of a line of feedstock samples may be arranged in an end-to-end fashion towards the processing compartment 804, which can be accomplished by activating a lever that ratchets the line of feedstock samples forward to the sample loader.

Apparatus 800 may also include a sample loader that has a slider to retract a catch pin in the tubular feedstock magazine 802 and to allow the spring-loaded feedstock sample to slide into a discharge position. The slider can actuate the sample loader to lift, drop, or otherwise maneuver the feedstock sample through an entry port into the processing compartment, which is located adjacent to the feedstock magazine. The sample retaining the catch pin is put back into position to hold the rest of the feedstock samples in the tubular feedstock magazine. Once the sample loader loads the feedstock sample into the processing compartment, an electric current pulse is applied to the feedstock sample, and a shaping pressure is applied to force the softened or heated feedstock sample into the mold 804 through the runner 808, either simultaneously or subsequently with the application of the electric current to heat the sample.

Once the amorphous article is formed, the plunger(s) is (are) retracted, and the processed part may be ejected from the stationary mold cavity with any remaining biscuit. In other embodiments where a mold magazine may be used, the mold cavity containing the processed part is moved away from a forming position, and another empty mold cavity is moved into the forming position.

The sample loader drops back to receive the next spring-loaded feedstock sample, while the slider is retracted and repositioned for the next feedstock sample. This sequential sample loading process continues until all feedstock samples loaded in the tubular feedstock magazine are processed.

In some embodiments, rapidly reloading the feedstock sample into the processing compartment involves the use of a bolt-action, in which a bolt engages to open and close a breech (barrel) that attaches to a small lever coupled to a handle. As the barrel (processing compartment) is rotated by the lever or handle, lugs on the end of the barrel align or misalign with complementary lugs on the bolt, which allows for a lock-up condition between the barrel and the lever. As the handle is rotated or cycled, the bolt is unlocked, and the barrel is opened for the placement of a new feedstock sample before the bolt is closed. This loading has the advantage of being strong enough to firmly hold the sample in place. This loading is also precise in its alignment of feedstock samples because the closing of the barrel and lock-up of the bolt's locking lugs can result in a single rigid structure.

In some embodiments, a feedstock sample in the linear (end-to-end) feedstock magazine may be loaded into a processing compartment by a gas injection system as an alternative to the mechanical sample loader, such as the spring as shown in FIG. 8. For example, the gas injection system may use gas pressure to load the feedstock sample into the processing compartment.

In some embodiments, the feedstock magazine may be oriented vertically, horizontally, or at an intermediate angle to the mold. For any feedstock magazine, regardless of orientation, the loading involves using a sample loader to maneuver the feedstock sample into the RDHF processing compartment in an automated fashion.

Figure 9:
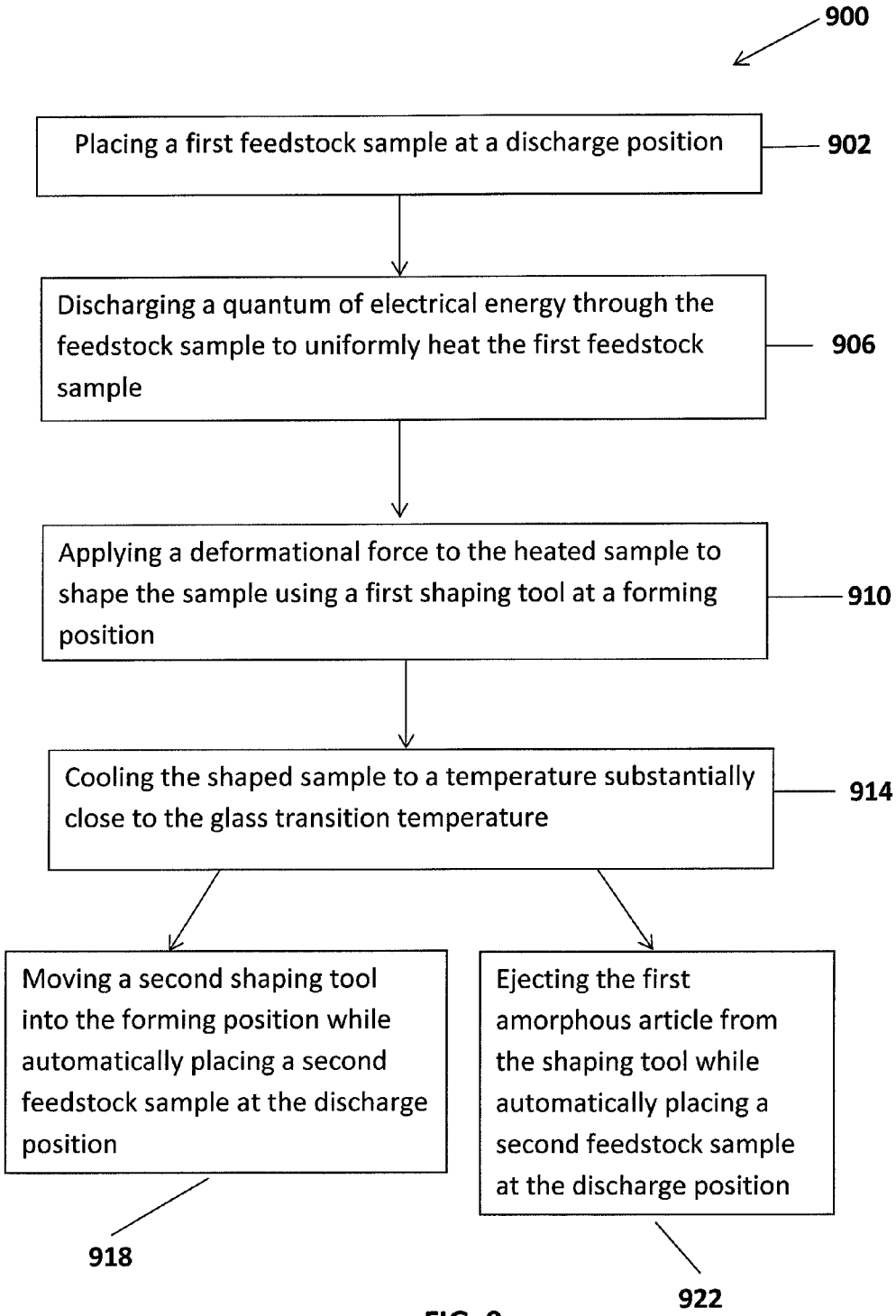
FIG. 9 provides a flow chart illustrating the steps for operating the RDHF apparatus to form amorphous articles in accordance with embodiments of the present disclosure.

FIG. 9 is a flow chart illustrating the steps for operating the RDHF apparatus to form amorphous articles in accordance with embodiments of the present disclosure. Method 900 starts with placing a first feedstock sample at a discharge position at block 902, followed by discharging a quantum of electrical energy through the feedstock sample to uniformly heat the first feedstock sample at block 906. The first feedstock sample can be placed at the discharge position by any feedstock magazine, for example, the disclosed revolving feedstock magazine, the disclosed linear (side-by-side) feedstock magazine, the disclosed linear (end-to-end) tubular feedstock magazine, or any other sample feeder.

Method 900 continues by applying a deformational force to the heated sample to shape the sample using a first shaping tool at a forming position at block 910, and cooling the first shaped sample to a temperature substantially close to the glass transition temperature, which may occur by conduction with the shaping tool, to form an amorphous article at block 914.

Then, method 900 includes automatically moving a second shaping tool into the forming position, while automatically placing a second feedstock sample at the discharge position, either into a second feedstock chamber, such as shown in FIGS. 1-2, or into the processing compartment, such as shown in FIGS. 3-8 at block 918.

In some embodiments, the shaping tool includes a mold 112 having at least one cavity and one runner, or a mold magazine 302 having a number of independent runners and mold cavities, such as shown in FIGS. 3 and 5, which may be used at block 918.

Alternatively, method 900 includes ejecting the first amorphous article from the shaping tool after the first amorphous article is cooled to a temperature substantially close to the glass transition temperature and prior to applying a deformational force to the second heated feedstock sample while automatically placing a second feedstock sample at the discharge position, for example, into a second feedstock chamber 106, such as shown in FIGS. 1-3, or in the processing compartment 304, as shown in FIGS. 4-8 at block 922.

In some embodiments, the shaping tool includes a mold 112 having at least one cavity and one runner, or a mold magazine 302 having a number of independent runners and mold cavities, such as shown in FIGS. 3 and 5, which may be used at block 922.

Although the above discussion has focused on the essential features of injection molding techniques, it should be understood that other shaping tools may be used with the RDHF method, such as extrusion, die casting dynamic forging, stamp forging, blow molding, etc., to form an amorphous article on a time scale of less than one second.

Moreover, additional elements may be added to these techniques to improve the quality of the final article. For example, to improve the surface finish of the articles formed in accordance with any of the above shaping methods, the mold or stamp may be heated to around or just below the glass transition temperature of the amorphous material, thereby smoothing surface defects. In addition, to achieve articles with better surface finish or net-shape parts, the deformational force, and in the case of an injection molding technique, the injection speed, of any of the above shaping techniques may be controlled to avoid a melt front break-up instability arising from high "Weber number" flows, i.e., to prevent atomization, spraying, flow lines, etc.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

The invention claimed is:

1. A rapid discharge heating and forming apparatus comprising:

at least one sample feeder configured to hold a plurality of feedstock samples, the at least one sample feeder configured to sequentially position at least one of the plurality of feedstock samples at a discharge position within at least one feedstock chamber, at least one pair of two electrodes interconnected to a source of electrical energy, each one of a pair of electrodes disposed at an opposing end of the feedstock sample and the electrodes configured to electrically connect to the feedstock sample at the discharge position and heat the feedstock sample at the discharge position; and a shaping tool configured to shape the heated feedstock sample to form an amorphous article.

2. The apparatus of claim 1, wherein the at least one sample feeder comprises a plurality of separate feedstock chambers, each feedstock chamber configured to contain a single feedstock sample, and each of the feedstock chambers movable into the discharge position.

3. The apparatus of claim 2, wherein the sample feeder is configured to be rotatable in relation to the at least two electrodes and the shaping tool, such that each of the plurality of feedstock chambers is rotated into the discharge position.

4. The apparatus of claim 1, wherein the at least one sample feeder comprises a single feedstock chamber, and is configured to sequentially place each of the plurality of feedstock samples into the feedstock chamber at the discharge position.

5. The apparatus of claim 4, wherein sample feeder is configured to provide each of the plurality of feedstock samples in end-to-end in series along the longitudinal axis of the feedstock samples.

6. The apparatus of claim 4, wherein the sample feeder is configured to provide each of the plurality of feedstock samples in parallel transverse to the longitudinal axis of the feedstock samples.

7. The apparatus of claim 4, wherein sample feeder is configured to provide each of the plurality of feedstock samples along a chain or a belt comprising a plurality of sample engagement seats configured to releasably retain a feedstock sample.

8. The apparatus of claim 4, wherein the sample feeder is coupled to a feedstock sample source, wherein each of the plurality of feedstock samples falls into the feedstock chamber by gravity.

9. The apparatus of claim 4, further comprising at least one of a spring loading or a pneumatic pressure component configured to move each of the plurality of feedstock samples into the feedstock chamber.

10. The apparatus of claim 1, wherein each feedstock chamber is fluidly connected to at least one corresponding feedstock channel, each feedstock channel fluidly connected to at least one shaping tool, and the at least one shaping tool comprises a mold.

11. The apparatus of claim 10, wherein the mold comprises a plurality of runners and cavities and is configured to rotate each mold cavity into a forming position such that at least one of the plurality of channels connects to at least one of the plurality of mold cavities at the forming position.

12. The apparatus of claim 10, wherein at least one of the electrodes is movable in relation to the at least one of plurality of feedstock chambers at the discharge position and configured to urge the heated feedstock sample into the at least one mold.

13. The apparatus of claim 1, wherein the at least one shaping tool comprises a forging die and the feedstock sample at the discharge position is at least partially exposed to the forging die.

14. The apparatus of claim 1, wherein shaping tool is configured to eject the amorphous article after the amorphous article has cooled to below 100 degrees above the glass transition temperature of the amorphous article, and before deformational force is applied to a second heated feedstock sample in the feedstock chamber.

15. The apparatus of claim 1, wherein the feedstock chamber comprises an electrically insulating film in contact with the feedstock sample at the discharge position.

16. The apparatus of claim 1, wherein the bulk material of the feedstock channel is electrically insulating.

17. The apparatus of claim 1, wherein the apparatus further comprises a plurality of sample feeders, each feeder movable into positioning alignment with the feedstock chamber.

18. A method for rapid discharge heating and forming of an amorphous article, the method comprising:

placing a first feedstock sample at a discharge position in the apparatus of claim 1;

discharging a quantum of electrical energy through the feedstock sample to heat the first feedstock sample to a processing temperature;

applying a deformational force to the heated feedstock sample to shape the feedstock sample;

cooling the shaped feedstock sample to form an amorphous article; and moving the first amorphous article out of the discharge position and placing a second feedstock sample into the discharge position.

19. The method of claim 18, wherein the processing temperature is between the glass transition temperature of the metallic glass and the equilibrium melting temperature of the glass forming alloy.

20. The method of claim 18, wherein the feedstock sample is shaped into an amorphous bulk article via any of the following techniques including injection molding, hot extrusion, dynamic forging, stamp forging, blow molding.

* * * * *